United States Patent [19]

Bennett et al.

[11] 4,201,251

[45] May 6, 1980

[54] ANTI-SPILLING SAFETY DEVICE FOR HIGH-SPEED FILLING MACHINES

[75] Inventors: Richard N. Bennett, Arbutus; Albert Lichaa, Baltimore, both of Md.

[73] Assignee: National Instrument Co., Inc., Baltimore, Md.

[21] Appl. No.: 912,317

[22] Filed: Jun. 5, 1978

[51] Int. Cl.[2] ..... B65B 43/42; B67C 3/20

[52] U.S. Cl. ..... 141/284; 141/155

[58] Field of Search ..... 141/129–191, 141/280–284

[56] References Cited

U.S. PATENT DOCUMENTS

| | | | |
|---|---|---|---|
| 3,036,604 | 5/1962 | Donofrio | 141/180 |
| 3,509,921 | 5/1970 | Adamik | 141/263 |
| 3,570,558 | 3/1971 | Lachaussee | 141/158 |
| 3,870,089 | 3/1975 | Laub | 141/158 |

FOREIGN PATENT DOCUMENTS

| | | | |
|---|---|---|---|
| 555833 | 9/1943 | United Kingdom | 141/158 |
| 566937 | 1/1945 | United Kingdom | 141/158 |

*Primary Examiner*—Houston S. Bell, Jr.
*Attorney, Agent, or Firm*—Craig & Antonelli

[57] ABSTRACT

A safety mechanism for high-speed filling machines preventing accidental spilling in case of misalignment between a nozzle and the container into which it is to be lowered during filling; a safety arm which normally closes a switch is displaced by a nozzle in case the latter encounters an obstruction and moves relative to its nozzle holder after overcoming the restraining force of a releasable detent mechanism to thereby open the switch and therewith stop the filling operation.

8 Claims, 3 Drawing Figures

ANTI-SPILLING SAFETY DEVICE FOR HIGH-SPEED FILLING MACHINES

The present invention relates to an anti-spilling safety device for high-speed filling machines intended to prevent spilling of the product to be dispensed by the machine in case of non-alignment between the lowerable nozzle and the respective container into which the nozzle is to be lowered.

High-speed filling machines are known in the prior art which include a plurality of filling units operable to dispense during the discharge stroke thereof a predetermined amount of a product through filling nozzles into empty containers held stationary on a continuously running conveyor, whereby the nozzles are adapted to be lowered into the stationary containers prior to the discharge stroke and are adapted to be raised out of the same before release of the filled containers, as described, for example, in the U.S. Pat. No. 2,807,213. To prevent misalignment between the nozzles and the containers into which they are lowered, various indexing mechanisms are known in the prior art as disclosed, for example, in the U.S. Pat. Nos. 3,067,768, 3,237,661 and 4,083,389, which are intended to stop the containers on the continuously movable conveyor in accurately predetermined position to assure proper alignment between the lowerable discharge nozzles and the containers to be filled during each cycle of the filling machine. These prior art indexing mechanisms are quite satisfactory and assure proper operation under most operating conditions. Nonetheless, a misalignment between a container or containers and the nozzle or nozzles which are to be lowered into the container or containers cannot be completely precluded. If this happens, a spilling of the product intended to be normally discharged in the container onto the conveyor or onto other parts of the machine is the result thereof since the prior art filling machines continue to operate regardless of whether or not proper alignment exists between the lowerable nozzles and the containers to be filled which are held stationary at a given time.

It is the aim of the present invention to avoid the aforementioned shortcomings by structurally simple means and to provide a safety mechanism which effectively prevents spilling of the product if misalignment should ever occur.

The underlying problems are solved according to the present invention in that proper alignment between all the nozzles and their respective containers are continuously monitored and the filling operation of the filling machine is stopped in case a misalignment between one or more nozzles and their respective containers is detected before the discharge stroke commences that would lead to a spilling. More specifically, the nozzles are frictionally held in their nozzle holders by a spring-loaded detent in such a manner that when a nozzle encounters an obstruction, for example, the rim of a container opening or neck or shoulder thereof, the nozzle is released out of its nozzle holder against the action of the spring-loaded detent and relative movement between this nozzle and its nozzle holder during the further lowering movement of the nozzle holder lowering mechanism causes the non-aligned nozzle to actuate a member normally closing a microswitch which upon being opened interrupts the operation of the filling machine. In multi-nozzle filling machines in which a number of filling nozzles, for example, 4, 8 or more nozzles, are mounted on a common nozzle support structure adapted to be raised and lowered, the microswitch is mounted on the up and down reciprocating nozzle support structure and its contact arm is so arranged as to be normally closed by a safety member extending in the longitudinal direction of the machine along the nozzles and nozzle holders spaced in such a manner that the safety member will be pivoted, possibly against the action of a spring normally urging the member into the closing direction of the microswitch, when a nozzle is released from its spring-loaded nozzle holder and, as a result of the ensuing relative motion, strikes the safety member, thereby pivoting it in a direction causing disengagement thereof from the contact member of the microswitch.

The present invention is characterized by an extremely simple and highly reliable safety mechanism which effectively prevents any spilling due to misalignment between nozzles and containers. Moreover, the system of the present invention operates fully automatically and can be installed also subsequently into existing machines by simple means to equip the same with this safety feature. Furthermore, the parts involved in the safety device of the present invention are relatively few in number and easy to manufacture, insofar as they do not already involve commercially available items.

Accordingly, it is an object of the present invention to provide an anti-spill safety mechanism which avoids by simple means the aforementioned shortcomings and drawbacks encountered in the prior art.

Another object of the present invention resides in an anti-spill safety mechanism for high-speed filling machines which is simple in construction, automatic in operation and highly reliable for its intended purpose.

A further object of the present invention resides in an anti-spill safety mechanism for high-speed filling machines which detects any misalignment between a nozzle and a corresponding container and interrupts the operation of the machine before any spilling can take place.

A still further object of the present invention resides in an anti-spill safety mechanism for high-speed filling machines which can be readily installed into existing machines without the use of complicated, costly modifications.

Still another object of the present invention resides in an anti-spill safety mechanism of the type described above which utilizes relatively simple parts, that are easy to install and adjust for proper operation of the device.

These and other object, features and advantages of the present invention will become more apparent from the following description when taken in connection with the accompanying drawing which shows, for purposes of illustration only, one embodiment in accordance with the present invention, and wherein.

Figure 2:
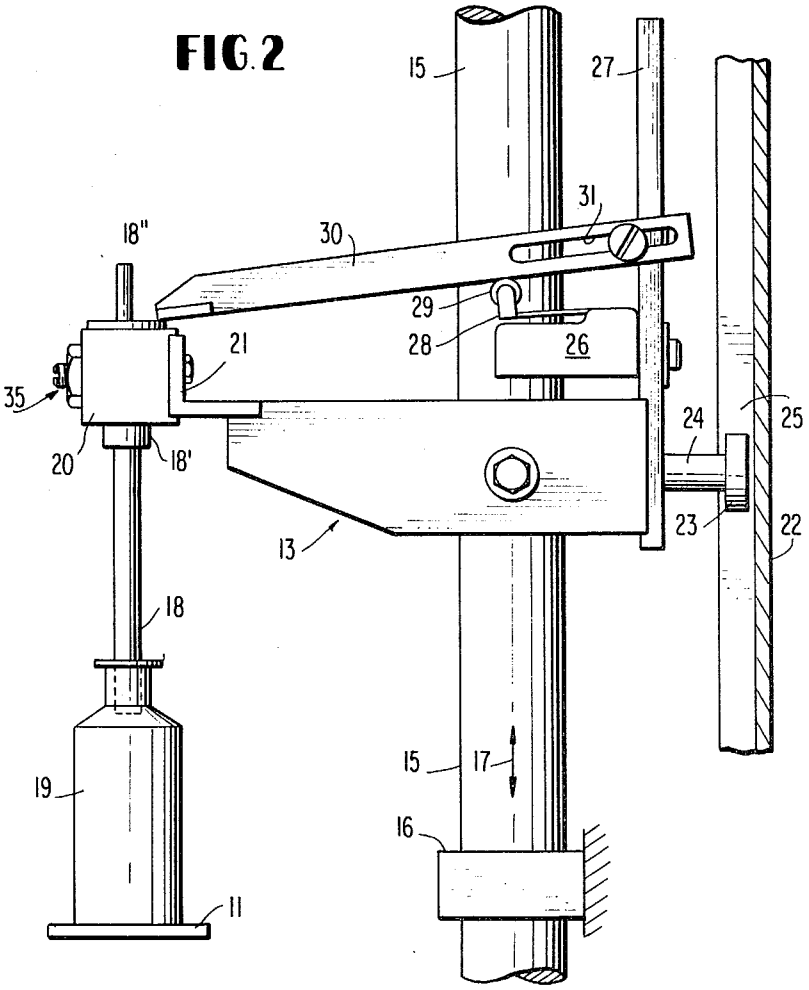
FIG. 2 is a schematic side elevational view, similar to FIG. 1, illustrating the parts thereof during normal operation when the nozzle is aligned with the container.
Figure 1:
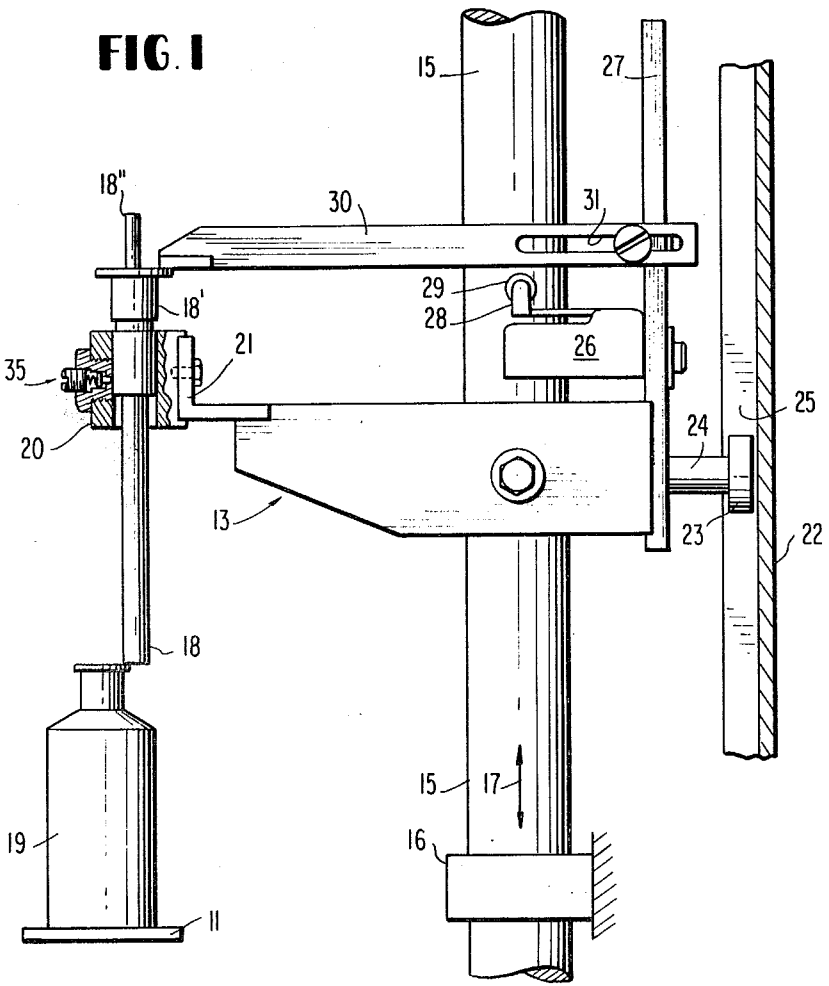
FIG. 1 is a schematic side elevational view of one embodiment of an anti-spill safety mechanism for high-speed filling machines in accordance with the present invention, illustrating the position of the various parts thereof in case of a misalignment between a nozzle and the respective container.
Figure 3:
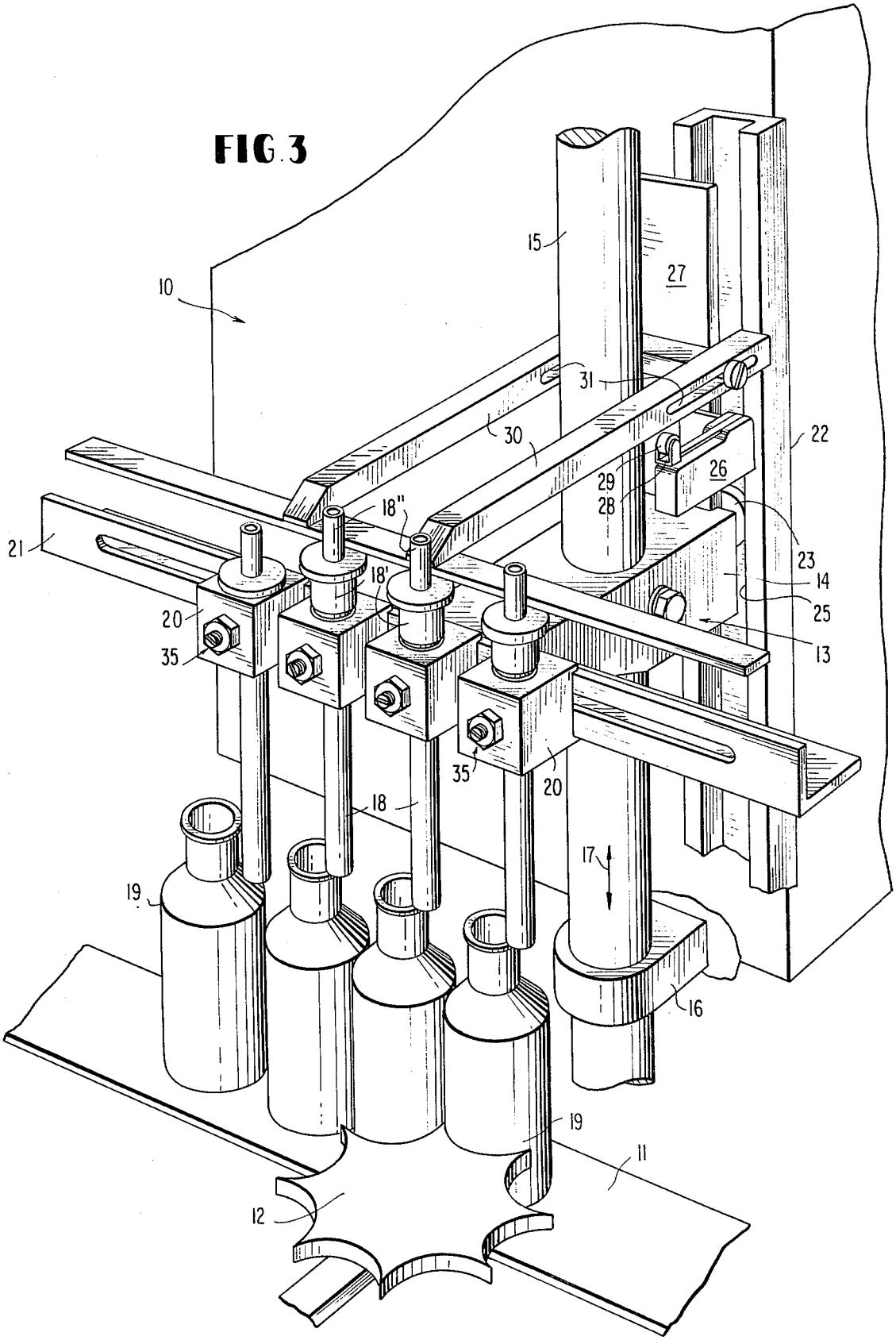
FIG. 3 is a partial perspective view showing the safety mechanism according to the present invention in a high-speed filling machine having four filling units connected with four filling nozzles.

Referring now to the drawing wherein like reference numerals are used throughout the various views to designate like parts, and more particularly to FIG. 3, reference numeral 10 generally designates the housing of a conventional filling machine, for example, as described in any of the aforementioned prior U.S. patents. Only those parts of the filling machine are shown in FIGS. 1 to 3 which are believed of assistance for an understanding of the present invention.

In addition to a continuously moving endless conveyor 11, by means of which the empty containers are transported to the filling station and upon filling thereat are conducted away therefrom, the filling machine also includes an indexing mechanism of any conventional construction to hold the bottles stationary on the continuously moving conveyor 11 while at the filling station to permit filling thereof from the filling machine with a given product to be dispensed. In the illustrated embodiment (FIG. 3), the indexing mechanism is a starwheel indexing mechanism generally designated by reference numeral 12 of the type disclosed in U.S. Pat. No. 4,083,389.

A nozzle support structure generally designated by reference numeral 13 includes a support member 14 suitably secured onto an upright column or tubular support member 15 operable to reciprocate in the vertical direction relative to the filling machine by being slidingly supported in suitable bearing parts fixed on the machine, of which bearing part 16 is schematically shown in the drawing. The tubular support member 15 moves down and up, as indicated by the arrow 17, in proper timed relationship to the cycle of operation of the filling machine, as known in the art, so as to lower in unison the filling nozzles 18, for example, four nozzles 18, into the containers 19 prior to the commencement of the discharge or filling stroke of the filling units (not shown) and to raise the nozzles again after completion of the discharge stroke and prior to release of the containers 19 by the indexing mechanism 12. Each nozzle 18 is thereby supported on the support structure 13 by way of an individual nozzle holder 20 which is suitably mounted on a slotted longitudinal bar member 21 to permit adjustable spacing of the individual nozzles 18 in the longitudinal direction in conformity with the dimensions of the containers to be filled. The slotted longitudinal bar member 21 is thereby fixed to the support member 14 by any suitable means.

The upright reciprocable column-like support member 15 together with the support structure 13 are suitably guided in their vertical movements by means of a slotted guide member 22 whose slot 25 is open in the direction toward the support structure 13, whereby a roller 23 mounted on a rearwardly projecting arm 24 engages in the slot 25 of the guide member 22 to provide an effective guidance during vertical reciprocations of the support structure 13. A normally open microswitch 26 is fixedly mounted though preferably adjustable relative to the support structure 13, for example, on a vertical member 27 permitting vertical adjustment of the microswitch 26 and includes a contact member 28 having a roller 29 adapted to be engaged by a safety arm 30 which is pivotally secured relative to the support structure 13. As shown in FIGS. 1 and 2, the safety arm 30 may be slotted as at 31 to permit adjustment in the transverse direction, i.e., in the direction of the safety arm 30 to adjust its position relative to the nozzles 18. A similar slotted arrangement may be provided to enable adjustment of the microswitch 26 relative to the vertical support member 27 which itself is fixed to the upright support member 14.

Each nozzle holder 20 includes a spring-loaded detent mechanism of commercial type which consists of a detent member spring-loaded to hold a respective nozzle 18 fixed by frictional engagement relative to the nozzle holder 20 during normal operation of the device. The detent mechanism only schematically indicated in the drawing where it is designated by reference numeral 35 may also include a screw member to adjust the prestress of the spring for the detent member which has, for example, a spherically shaped end portion in contact with the enlarged section 18' of the nozzle 18. If so desired, the enlarged section 18' of the nozzle 18 may also be provided with a circumferential groove for engagement by the end portion of the detent member to assure an even more accurate indexing, though tests have indicated that the frictional engagement without such groove is adequate for normal conditions.

When the containers 19 are properly aligned relative to the corresponding nozzles 18, as shown in FIG. 2, the lowering movement of the support structures 13, 14, 17, 18 and 21 will cause the nozzles 18 to enter the openings in the neck of the containers without any obstruction so that the safety arm 30, which may be spring-loaded by any conventional means in the closing direction of the microswitch 26, will hold the microswitch 26 in the closed condition. The microswitch 26 itself is interconnected in a circuit (not shown) controlling the operation of the filling machine, for example, in the circuit for the drive motor driving the filling machine or in the energizing circuit for the clutch mechanism coupling the drive shaft with the actuating shaft or shafts of the filling units.

When the nozzle 18 encounters an obstruction, for example, due to misalignment between a nozzle 18 and its container 19 as shown in FIG. 1, continued downward movement of the nozzle support structure 13 together with the nozzle holder 20 will cause relative movement thereof with respect to the nozzle 18 upon release of the latter by the spring-loaded detent mechanism 35, so that the nozzle 18 which may be provided at its upper end with a collar 18" causes in effect rotation of the safety arm 30 in the clockwise direction as viewed in FIGS. 1 and 2, thereby disengaging the arm 30 from the roller 29 and therewith causing the microswitch 26 to open. This in turn will stop the operation of the filling machine to prevent spilling before the discharge stroke begins.

In actual construction, the collar 18" may also be formed, for example, by the end face of a connecting assembly connecting the nozzle with the discharge hose.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An anti-spill safety mechanism for high-speed filling machines, comprising reciprocable nozzle means supported by nozzle holder means forming part of a nozzle support structure operable to move in the downward and upward direction in predetermined timed relationship to the cycle of operation of the filling machine, characterized in that a respective nozzle means is releasably held relative to its nozzle holder means, and safety means responsive to relative movement between the nozzle means and the nozzle holder means when the nozzle means encounters an obstruction in its movement in the direction toward a respective container to be filled, to stop the operation of the filling machine and thereby prevent spilling.

2. An anti-spill safety mechanism according to claim 1, characterized in that the safety means includes a safety member so mounted on the nozzle support structure that relative movement between the nozzle means and the nozzle holder means will cause movement of the safety member in a direction causing stoppage of the filling operation.

3. An anti-spill safety mechanism according to claim 2, characterized in that the safety member is an arm pivotally mounted on the nozzle support structure in such a manner as to normally engage with a switch means also mounted on said support structure, said arm being pivoted out of engagement with said switch means by relative movement between the nozzle holder means and the nozzle means when the nozzle means encounters an obstruction.

4. An anti-spill safety mechanism according to claim 2 or 3, characterized in that said safety member is spring-loaded in the closing direction of the switch means.

5. An anti-spill safety mechanism according to claim 3, characterized in that said switch means is interconnected in an electric circuit causing stoppage of the actuation of the filing units of the filling machine upon opening of the switch means.

6. An anti-spill safety mechanism according to claim 5, characterized in that said nozzle holder means includes a spring-loaded detent means whose detent member frictionally engages with the nozzle means.

7. An anti-spill safety mechanism according to claim 6, characterized in that said safety member is spring-loaded in the closing direction of the switch means.

8. An anti-spill safety mechanism according to claim 1, 2 or 3, characterized in that said nozzle holder means includes a spring-loaded detent means whose detent member frictionally engages with the nozzle means.

* * * * *